United States Patent [19]

Tahara

[11] Patent Number: 4,799,503

[45] Date of Patent: Jan. 24, 1989

[54] COMPACT COSMETIC CASE

[75] Inventor: Tomio Tahara, Tokyo, Japan

[73] Assignee: Kamaya Kagaku Kogyo Co., Ltd., Tokyo, Japan

[21] Appl. No.: 82,657

[22] Filed: Aug. 7, 1987

[30] Foreign Application Priority Data

Oct. 14, 1986 [JP] Japan ..... 61-157215
Jul. 3, 1987 [JP] Japan ..... 62-102403

[51] Int. Cl.[4] ..... A45D 33/00; A45D 40/00; A45D 40/22

[52] U.S. Cl. ..... 220/260; 206/823; 220/306; 220/DIG. 26; 292/DIG. 37

[58] Field of Search ..... 132/79 F, 79 G, 82 R, 132/83 R; 206/1.5, 235, 823; 220/315, 324, DIG. 26; 292/DIG. 37, 83-86

[56] References Cited

U.S. PATENT DOCUMENTS 3,442,414 5/1967 Pelli ..... 132/83 R X
4,679,576 7/1987 Yuhara et al. ..... 132/83 R X
4,683,899 8/1987 Yuhara et al. ..... 132/82 R

FOREIGN PATENT DOCUMENTS 60-44708 3/1985 Japan .
61-160812 10/1986 Japan .

*Primary Examiner*—Richard J. Apley
*Assistant Examiner*—David J. Bender
*Attorney, Agent, or Firm*—Cushman, Darby & Cushman

[57] ABSTRACT

A compact costmetic case which includes: a case body; a lid of the case body pivotally connected to the case body and adapted to be unfastenably fastened to the front portion of the peripheral wall of the case body; and a disengaging mechanism for unfastening the lid from the case body. The front portion of the peripheral wall of the case body has a recess having an end surface on which a first engaging member is formed. The lid has a second engaging member adapted to be engaged with the first engaging member. When the lid is in its closed position, the second engaging member is engaged with the first engaging member so that the lid is fastened to the case body. The disengaging mechanism is received in the recess of the case body. The disengaging mechanism has a sliding plate movable between outer and inner positions toward and away from the end surface of the recess. The disengaging mechanism also has, an urging leaf for pushing the second engaging member so as to disengage the first and second engaging members. The urging leaf urges the sliding plate in its outer position. The urging leaf includes first and second leaf pieces. The lower edge of the first leaf piece is connected to the inner surface of the sliding plate. The distal edge of the second leaf piece is in contact with the end surface of the recess, on the other hand, the proximal edge of the second leaf piece is connected to the upper edge of the first leaf piece in such a manner that the second leaf piece is inclined at an angle less than 180° with respect to the first leaf piece.

8 Claims, 7 Drawing Sheets

COMPACT COSMETIC CASE

BACKGROUND OF THE INVENTION

This invention relates to a flat-type compact cosmetic case for face powder, rouge, eye shadow, powder puff, etc., having a push button for disengaging the engagement between the case body and the lid.

A compact cosmetic case for face powder, rouge and the like, generally, has a pan-like case body and a substantially flat lid which is pivotally connected to the rear portion of the case body. This type of case usually has a fastening mechanism such that the free front end of the lid is unfastenably fastened to the front portion of the case body by means of two engaging projections when the lid is brought into its closed position. Among the various conventional fastening mechanisms are included disengaging operation members such as push buttons for disengaging projections so that the lid can be opened. To be prepared for the following lid-closing action, those disengaging operation members must be brought back to their initial positions after being released from pressing force.

An example of the conventional case having a push button is disclosed in Japanese Utility Model Application Laid-Open No. sho 60-44708. As shown in FIG. 1 and 2, a case body 1 of this compact cosmetic case has a recess 2 formed in its front wall portion 1*a*. This recess 2 is defined by an end surface 2*a*, a bottom surface 2*b* and opposite side surfaces 2*c*, and opens to the top and front faces of the front wall portion 1*a*. The end surface 2*a* of the recess 2 is provided with a projection 3 having its upper surface 3*a* tapering forwards. As shown in FIG. 2, the opposite end surfaces 2*c* of the recess 2 are provided with guide grooves 4 extending in a direction perpendicular to the end surface 2*a*. The depth of each guide groove 4 decreases gradually from its front to its rear end. A push button 6 is slidably received in the recess 2 for movement along the guide grooves 4.

The push button 6 includes: a sliding plate 6*a* adapted to be directly pressed by operator; two resilient strips 6*b* projecting from the inner surface of the sliding plate 6*a*; and a pivoting leaf 6*d* pivotally connected, for upward and downward movement, to the inner surface of the plate 6*a* through a hinge portion 6*c*. The resilient strips 6*b* fit slidably in the guide grooves 4 respectively. The free end of the pivoting leaf 6*d* is in contact with the slope 3*a* of the projection 3. As shown in FIG. 1, when the lid 5 is in its closed position, a engaging projection 5*a* of the lid 5 is in contact with the pivoting leaf 6*d* and is in engagement with a engaging projection 1*b* which is formed on the end surface 2*a*. When the push button 6 is pressed backward, the pivoting leaf 6*d* is pivoted upward under the guidance of the slope 3*a*. Then, the pivoting leaf 6*d* pushes the engaging projection 5*a* upward, causing the engaging projection 5*a* to be disengaged from the engaging projection 1*b*. Also, when the push button 6 is pressed, the resilient strips 6*b* are bent sideward, as shown in FIG. 2, under the guidance of the guide grooves 4. Therefore, the push button 6 is urged forward by the reaction force due to the bend of the resilient strips 6*b*. Consequently, button 6 is brought forward into its initial position when released from the pressing force.

However in the aforementioned compact cosmetic case, there arises the following problems: The front wall portion 1*a* of the case body 1 must be of a relatively large thickness $T_1$ since it is required to have a recess 2 deep enough to receive both the projection 3 and the pivoting leaf 6*d*. In other words, the thick front wall portion 1*a* restricts the length $L_1$ of the hollow 1*c* to a relatively small size. Furthermore, since the resilient strips 6*b* are flexed sidewards, only the forward component of the reaction force is exerted on the push button 6 in moving the push button 6 back to its initial position. That is to say, in the aforementioned case, the entire reaction force due to the bend of the resilient strips 6*b* is not efficiently utilized.

Another example of the conventional compact cosmetic case is disclosed in Japanese Utility Model Application Laid-Open No. sho 61-160812. As shown in FIG. 3 and 4, the end surface 7*a* of a recess 10 of this case does not have a projection, and thus it is much easier for this cosmetic case to have the front wall portion of a relatively small thickness than for the previously mentioned conventional case. Instead of the projection, this case has an urging leaf 9*e* inclined to the bottom surface 7*c* of the recess 10. This urging leaf 9*e* is connected to the lower edge of a sliding plate 9*a* through a resilient strip 9*d*, and is in contact with the end surface 7*a* of the recess 10. As shown in FIG. 3, when a lid 8 is in its closed position, an engaging projection 8*b* of the lid 8 is adjoined to the free end of the urging leaf 9*e* and is in engagement with an engaging projection 7*b* which is formed on the end surface 7*a* of the recess 10. When the push button 9 is pressed backward as shown in FIG. 4, the urging leaf 9*e* is pivoted upward under the guidance of the end surface 7*a*, whereby the engaging projection 8*b* is pushed upward and is disengaged from the engaging projection 7*b*. The resilient strip 9*d* also serves as means for generating biasing force when the push button 9 is pressed. When the button 9 is pressed, the resilient strip 9*d* is elastically deformed, and thus, by the reaction force due to the deformation of the resilient strip 9*d*, the push button 9 is urged forward.

However in the above-described case, since only the resilient strip 9*d* (the thickness of which is substantially thinner than the urging leaf 9*e*) is used as means for generating the urging force, the push button of the case is prevented from having a sufficient durability. For example, a small plastic deformation in the resilient strip 9*d* due to elastic fatigue can greatly reduce the urging force of the resilient strip 9*d* so that the push button is not able to return to its initial position.

SUMMARY OF THE INVENTION

Accordingly, it is an object of the present invention to provide a compact cosmetic case in which the push button has a simple arrangement capable of exerting a urging force large enough to bring the disengaging means to its initial position.

Another object of the present invention is to provide a compact cosmetic case in which the push button has an excellent durability.

Still another object of the present invention is to provide a compact cosmetic case in which the front wall portion of the case body is of potentially a smaller thickness than those of conventional cases, thereby increasing the ratio of the length of the case body's hollow to the thickness of the front wall portion.

With these and other objects in view, the present invention provides a compact cosmetic case comprising: a case body having the peripheral wall; a lid pivotally connected to the rear portion of the peripheral wall of the case body and adapted to be unfastenably fastened to the front portion of the peripheral wall of the case body; and a push button for unfastening the lid from the front portion of the peripheral wall of the case body. The front portion of the peripheral wall has a recess opening to both its top and front faces. The recess has bottom and end surfaces, the end surface extending between the bottom surface of the recess and the top face of the front portion. The recess has a first engaging member projecting from its end surface. The lid has a second engaging member adapted to be engged with the first engaging member of the case body. When the lid is in its closed position, the second engaging member is engaged with the first engaging member so that the lid is fastened to the front portion of the peripheral wall of the case body. The push button is received in the recess of the case body. This push button includes a sliding plate facing the end surface of the recess. The sliding plate is movable between outer and inner positions toward and away from the end surface of the recess. The push button also includes an urging leaf interposed between the sliding plate and the end surface of the recess. The urging leaf urges the sliding plate away from the end surface of the recess, i.e., urges it in its outer position. The urging leaf comprises first and second leaf pieces. The lower edge of the first leaf piece is connected to the inner surface of the sliding plate. The distal edge of the second leaf piece is in contact with the end surface of the recess, while on the other hand, the proximal edge of the second leaf piece is connected to the upper edge of the first leaf piece in such a manner than the second leaf piece is inclined at an angle less than 180° with respect to the first leaf piece. When the sliding plate is in its outer position, the distal edge of the second leaf piece is disposed at a level below the first engaging member.

When the sliding plate is brought into its inner position, the urging leaf is bent so that the distal edge of the second leaf piece is brought to a level generally equal to the first engaging member. That is, when the push button is pressed, the second engaging member is pushed upward by the distal edge of the second leaf piece, whereby the second engaging member of the lid is disengaged from the first engaging member of the case body. Furthermore, when the push button is pressed, the urging leaf is flexed in such a manner that the angle between the first and second leaf pieces is enlarged. Thus, the sliding plate is urged more severely by the reaction force due to the flexure of the urging leaf itself. Therefore, after the push button is released from the pressing force, it is with high reliability brought back into its outer position, i.e., its initial position. Since, in this push button, the entire urging leaf it utilized as means for generating the urging force, the push button has an excellent durability. Also, since only hooked urging leaf is interposed between the sliding plate and the end surface of the recess, the front portion of the peripheral wall is of potentially a smaller thickness than those of conventional cases.

DETAILED DESCRIPTION OF THE PREFERRED EMBODIMENT

Figure 1:
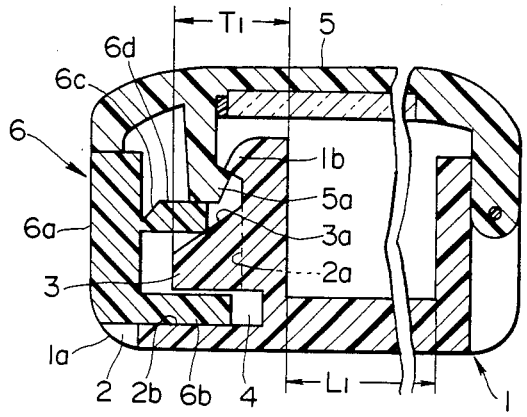
FIG. 1 (PRIOR ART)
FIG. 1 is a fragmentary cross-sectional view of a conventional compact cosmetic case.
Figure 2:
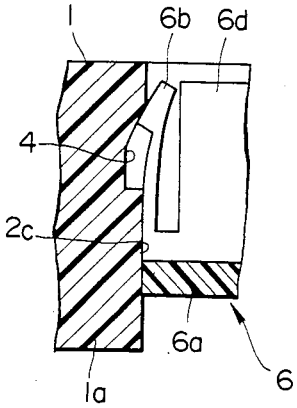
FIG. 2 (PRIOR ART)
FIG. 2 is an enlarged fragmentary plan view, partly in section, of a push button and a front wall portion of a case body in FIG. 1.
Figure 3:
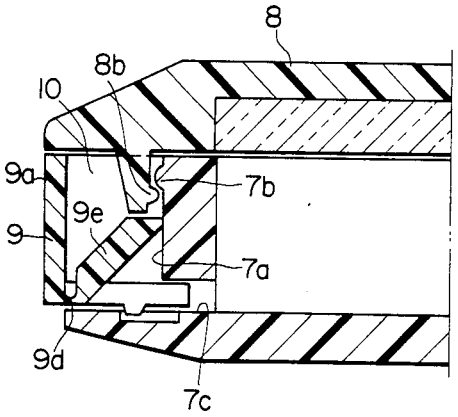
FIG. 3 (PRIOR ART)
FIG. 3 is a fragmentary cross-sectional view of another conventional compact cosmetic case.
Figure 4:
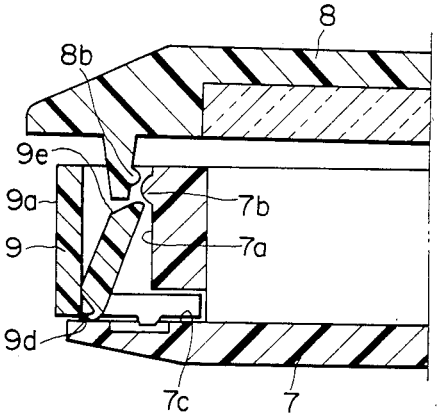
FIG. 4 (PRIOR ART)
FIG. 4 is a fragmentary cross-sectional view of the cosmetic case in FIG. 3, with its lid opened.
Figure 5:
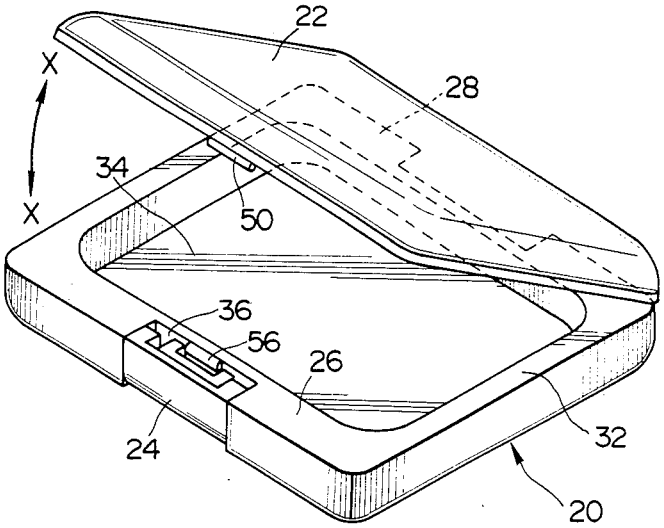
FIG. 5 is a perspective view of a compact cosmetic case according to the present invention.

In FIGS. 5 to 15, like reference characters designate corresponding parts throughout views, and descriptions of the corresponding parts are omitted once given.

FIGS. 5 to 9 illustrate a compact cosmetic case according to the present invention. This cosmetic case includes a flat and generally rectangular case body 20, a lid 22 of the case body 20 having the corresponding rectangular shape, and a push button 24 as disengaging means. The case body 20 has bottom and peripheral walls 30 and 32 which define at the center of the case body 20, a hollow 34 for containing face powder, compact face powder, foundation powder and the like. The lid 22 is pivotally connected to the rear portion 28 of the peripheral wall 32 of the case body 20 for movement in the direction indicated by arrow X—X. A mirror plate 21 is attached on the inner face 23 of the lid 22, and a support member 50 is protruded from that portion of the inner face 23 adjacent to the front edge 54 of the lid 22 (see FIG. 6). The support member 50 includes a ridge-like engaging projection 52 as a second engaging member formed on that portion of its inner face adjacent to the lower end of the support member 50. The push button 24 is received in a recess 36 which is formed in the front portion 26 of the peripheral wall 32 of the case body 20.

Figure 6:
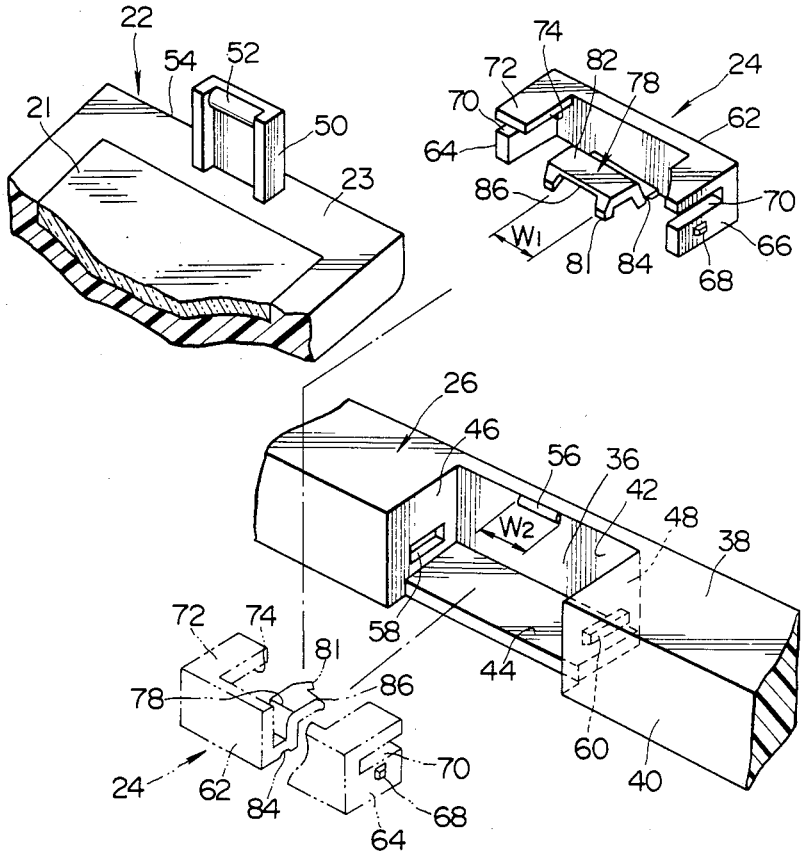
FIG. 6 is an exploded fragmentary perspective view of a case body, a lid and a push button in FIG. 5.

As shown in FIG. 6, the recess 36 is formed in the front portion 26 of the peripheral wall 32 of the case body 20 so as to open to both the top and front faces 38 and 40 of the front portion 26 of the peripheral wall 32. The recess 36 is defined by its inner surface consisting of an end surface 42, a bottom surfce 44 and opposite side surfaces 46 and 48. The bottom surface 44 of the recess 36 is substantially parallel to the top face 38 of the front portion 26. The end surface 42 extends between the bottom surface 44 of the recess 36 and the top face 38 of the front portion 26. The side surfaces 46 and 48 are perpendicular to both the bottom and end surfaces 44 and 42 of the recess. On the upper edge of the end surface 42 of the recess 36, there is formed a ridge-like engaging projection 56 as a first engaging member which is adapted to engage with the engaging projection 52 of the lid 22. Furthermore, guide grooves 58 and 60 are formed respectively in the side surfaces 46 and 48 of the recess 36. These grooves 58 and 60 extend in a direction perpendicular to the end surface 42 of the recess 36.

Figure 7:
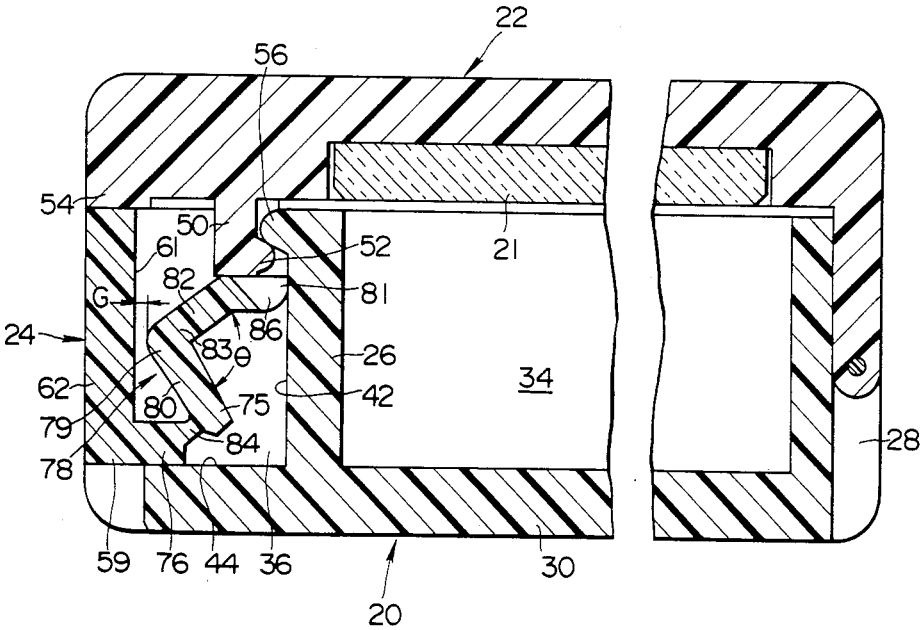
FIG. 7 is a fragmentary cross-sectional view of the cosmetic case in FIG. 5.

As further shown in FIG. 6, the push button 24 includes a sliding plate 62 facing the end surface 42 of the recess 36. This sliding plate 62 is provided at its opposite side edges with side lips 64 and 66 extending toward the end surface 42 of the recess 36. Each of the side lips 64 and 66 has a protrusion 68 slidably fit in the corresponding guide groove 58 or 60 so that the sliding plate 62 is movable toward and away from the end surface 42 along the grooves 58 and 60 but does not come off the recess 36. A slit 70 is formed between each of the side lips 64 and 66 and an upper lip 72 in order to facilitate fitting of the protrusion 68 into the groove. The upper lip 72 has an indentation 74 to avoid the interference between it and the support member 50 of the lid 22. As shown in FIG. 7, the sliding plate 62 is also provided along its lower edge 59 with a ridge 76 that projects backward (i.e., toward the end surface 42 of the recess 36) from its inner surface 61. To this ridge 76, an urging leaf 78 is connected via a resilient strip 84. The resilient strip 84 is disposed along the ridge 76, and has a much smaller thickness than the urging leaf 78. The urging leaf 78 is interposed between the sliding plate 62 and the end surface 42 of the recess 36, and urges the sliding plate 62 in its outer position, i.e., its initial position. This urging leaf 78 includes first and second leaf pieces 80 and 82. The first leaf piece 80 is connected at its lower edge 75 to the resilient strip 84, and extends generally upward. On the other hand, the second leaf piece 82 is connected at its proximal edge 83 to the upper edge 79 of the first leaf piece 80 and extends toward the end surface 42 of the recess 36. That is, the second leaf piece 82 is inclined at a predetermined angle 0 with respect to the first leaf piece 80. The angle 0 is more than 0° and less than 180°, and preferably around 90°. When the push button 24 is not pressed, i.e., when the sliding plate 62 is in its initial position, the upper edge 79 of the first leaf piece 80 is spaced at a distance G from the inner surface 61 of the sliding plate 62, and the distal edge 81 of the second leaf piece 82 is in direct contact with that portion of the end surface 42 beneath the engaging projection 56. A notch 86 is formed at the distal edge 81 of the second leaf piece 82 to prevent the second leaf piece 82 from butting against the engaging projection 56 of the case body 20. As shown in FIG. 6, the width $W_1$ of the notch 86 is, naturally, larger than the width $W_2$ of engaging projection 56 of the case body 20.

The operation of the case thus arranged will now be described. As shown in FIG. 7, when the lid 22 is in its closed position, the engaging projection 52 of the lid 22 is engaged with the engaging projection 56 of the case body 20. Also when the lid 22 is in its closed position, the front edge 54 of the lid 22 and the lower end of the support member 50 are in contact respectively with the upper edge of the sliding plate 62 and the distal edge 81 of the urging leaf 78.

Figure 8:
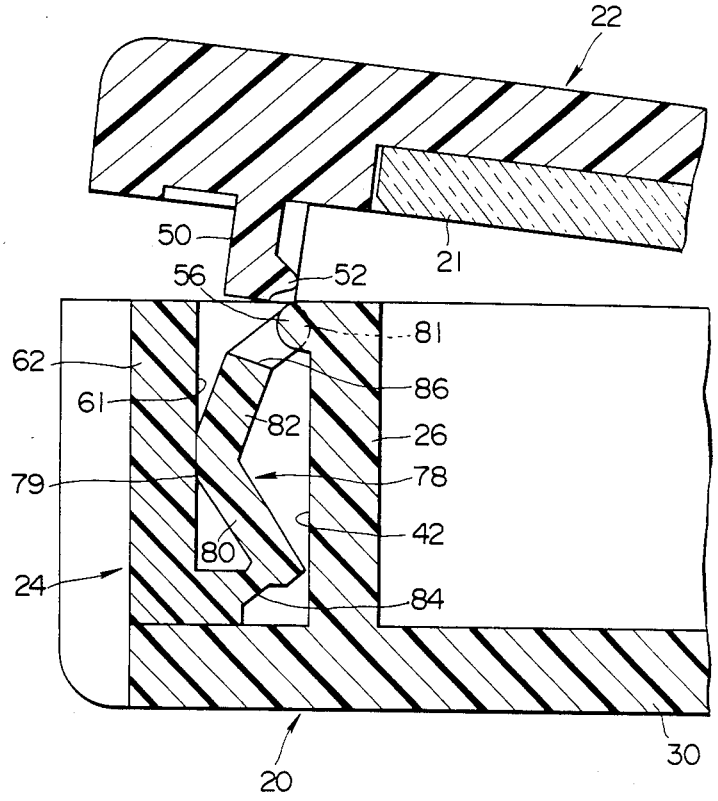
FIG. 8 is a fragmentary cross-sectional view of the cosmetic case In FIG. 5, with its lid opened.

The push button 24 is pressed when the opening of the lid 22 is required. As shown in FIG. 8, when the push button 24 is pressed, the urging leaf 78 is compressed between the sliding plate 62 and the end surface 42. As the push button 24 is gradually pressed, the entire urging leaf 78 is pivoted forward about the resilient strip 84 until the upper edge 79 of the first leaf piece 80 is brought into direct contact with the inner surface 61 of the sliding plate 62. Subsequently, when the ends of the side lips 64 and 66 are brought into contact with the end surface 42 of the recess 36 (that is, when the sliding plate 62 reaches its inner position), the urging leaf 78 is flexed in such a manner that its distal edge 81 reaches a level generally equal to the engaging projection 56. That is, the pressing of the push button 24 causes the urging leaf 78 to push the support member 50 upward, thereby disengaging the engaging projections 52 and 56 and opening the lid 22. The notch 86 of the second leaf piece 82 enables the distal edge 81 of the second leaf piece 82 to reach a position at the same level as the engaging projection 56, facilitating not only the reliable disengagement of the engaging projections 52 and 56 but also the opening of the lid 22. When the push button 24 is pressed, the resilient strip 84 is flexed forward and the urging leaf 78 is also flexed so that the angle between the first and second leaf pieces 80 and 82 is enlarged. In other words, while it is pressed, the sliding plate 62 is urged forward by the reaction force due to the flexure of both the resilient strip 84 and the urging leaf 78 itself. Therefore, when the push button is released from the pressing force, the sliding plate 62 is with high reliability brought back into its initial position.

When the closing of the lid 22 is required, the lid 22 is merely pushed downward from the position shown in FIG. 8. By pushing the lid 22, the engaging projection 52 of the lid 22 comes down beyond the engaging projection 56 of the case body 20, which results in the engagement between the engaging projections 52 and 56.

Figure 9:
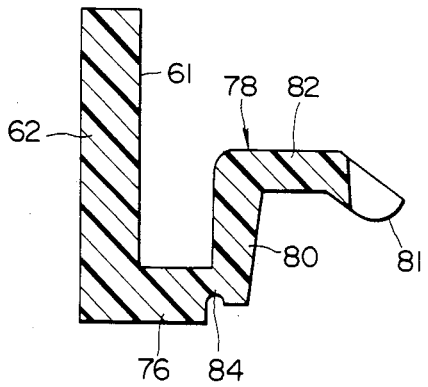
FIG. 9 is a cross-sectional view of the push button in FIG. 5, showing its original shape immediately after the molding.

The push button 24 is made of resilient material such as synthetic resin which has been molded into a unitary construction. Hence, upon the completion of the molding of the push button, it has a shape as is shown in FIG. 9, i.e., a shape in which the first leaf piece 80 is parallel to the sliding plate 62. Consequently, even in FIG. 7 in which the sliding plate 62 is in its initial position, the sliding plate 62 is urged away from the end surface 42 by the reaction force due to the elastic deformation of the resilient strip 84. By that fact, it is guaranteed that the urging force brings the sliding plate 62 back to its initial position after the push button 24 is released. The distance G between the sliding plate 62 and the urging leaf 78 prevents any unnecessary disengagement of the engaging projections 52 and 56 due to an accidental pressing of the push button 24 because the distance G creates a lapse of time between the pressing of the push button 24 and the opening of the lid 22. The amount of time lapse can be adjusted by adjusting the distance G.

Figure 10:
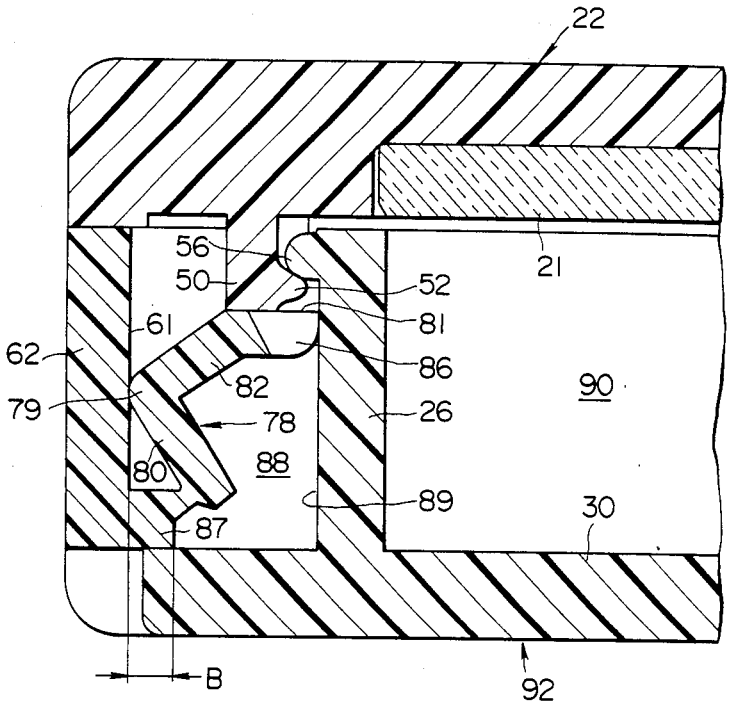
FIG. 10 is a fragmentary cross-sectional view of a modified form of the cosmetic case in FIG. 7.

FIG. 10 shows a modified form of the cosmetic case in FIG. 7, in which a ridge 87 is of a smaller thickness B than that of ridge 76 in FIG. 7, and a recess 88 is of a smaller depth D than that of the recess 36 in FIG. 7. Accordingly, the upper edge 79 of the first leaf piece 80 is in contact with the inner surfce 61 of the sliding plate 62 when the sliding plate 62 is in its initial position. In this arrangement, the distal edge 81 of the second leaf piece 82 reacts, i.e., pushes the support member 50 of the lid 22 upward as soon as the push button 24 is pressed. Naturally, the hollow 90 of the case body 92 can be larger than that of the case body 20 in FIG. 7.

Figure 11:
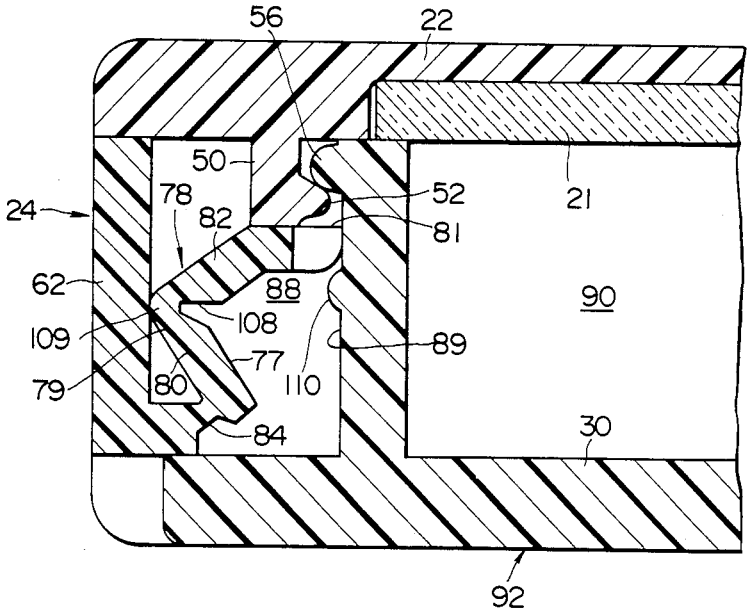
FIG. 11 is a fragmentary cross-sectional view of another modified form of the cosmetic case in FIG. 7.

Another modified form of the cosmetic case in FIG. 7 is illustrated in FIG. 11, in which a partition groove 108 is formed in that portion of the inner face 77 of the urging leaf 78 between the first and second leaf pieces 80 and 82. The groove 108 extends along the entire upper edge 79 of the first leaf piece 80, thereby forming a hinge portion 109 of a relatively small thickness between the first and second leaf pieces 80 and 82. Moreover, a stopper ridge 110 parallel to the engaging projection 56 is formed on that portion of the end surface 89 beneath the projection 56 so that the free end 81 of the leaf 78 is disposed between the ridge 110 and the engaging projection 56. When the urging leaf 78 is flexed upward, a stress due to the flexure develops mainly in the hinge portion 109 of the leaf 78, that is, the main portion of the leaf 78 is not flexed severely. Therefore, the lengths of both the first and second leaf pieces 80 and 82 are effectively utilized for the pushing up of the lid 22. The stopper ridge 110 prevents the free end 81 of the leaf 78 from sliding downward underneath the ridge 110. Hence, the ridge enhances the reliability of the push button 24 in opening the lid 22 and in returning to its initial position.

Figure 12:
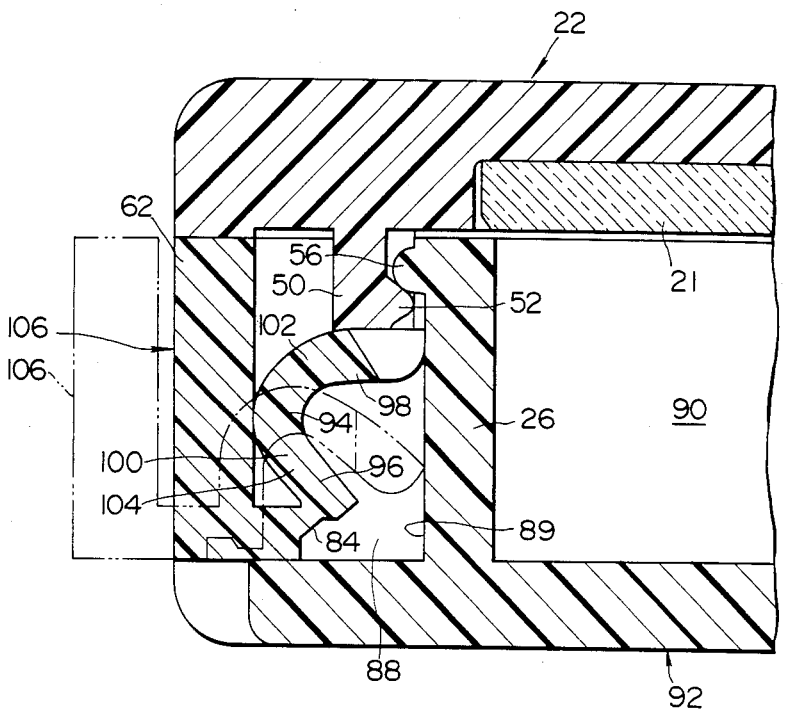
FIG. 12 is a fragmentary cross-sectional view of still another modified form of the cosmetic case in FIG. 7.

FIG. 12 illustrates still another modified form of the cosmetic case in FIG. 7, in which a channel-shaped curved element 94 is interposed between a first leaf piece 96 and a second leaf piece 98. One of the opposite edges 100 and 102 of the curved element 94 is joined to the upper edge 104 of the first leaf piece 96 so that the second leaf piece 98 joined to the other edge of the curved element 94 extends toward the end surface 89 of the recess 88. The push button 106 is molded into a shape as shown by the phantom line in FIG. 12, and thus the sliding plate 62 is urged forward by the reaction force due to the deformation of the resilient strip 84 even when the sliding plate 62 is in its initial position.

Figure 13:
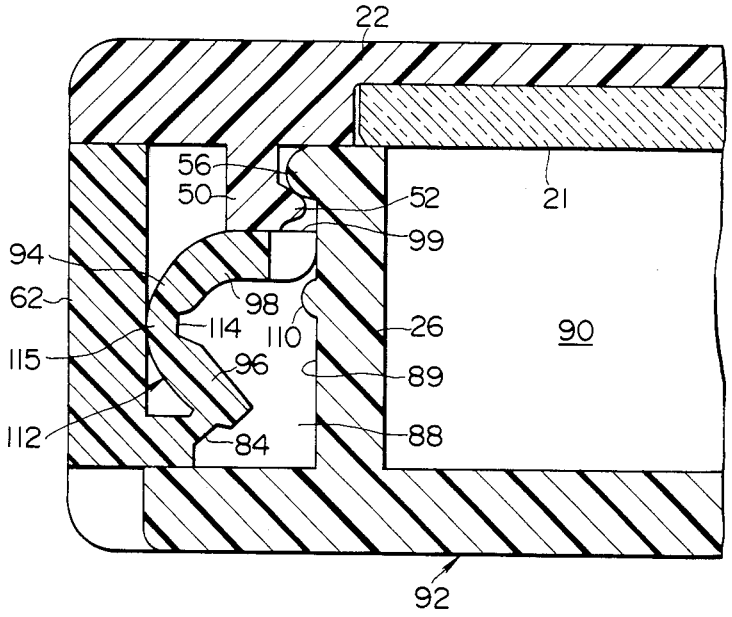
FIG. 13 is a fragmentary cross-sectional view of further modified form of the cosmetic case in FIG. 7.

A further modified form of the compact cosmetic case in FIG. 7 is shown in FIG. 13. Just as the case in FIG. 12, the urging leaf 112 of this case has a curved element 94, and as the case in FIG. 11, it has a partition groove 114 formed in the inner face of the curved element 94 so as to have a hinge portion 115 in it. Furthermore, a stopper ridge 110 is provided on the end surface 89 of the recess 88 in order to prevent the distal edge 99 of the leaf 112 from sliding downward beyond the ridge 110.

Figure 14:
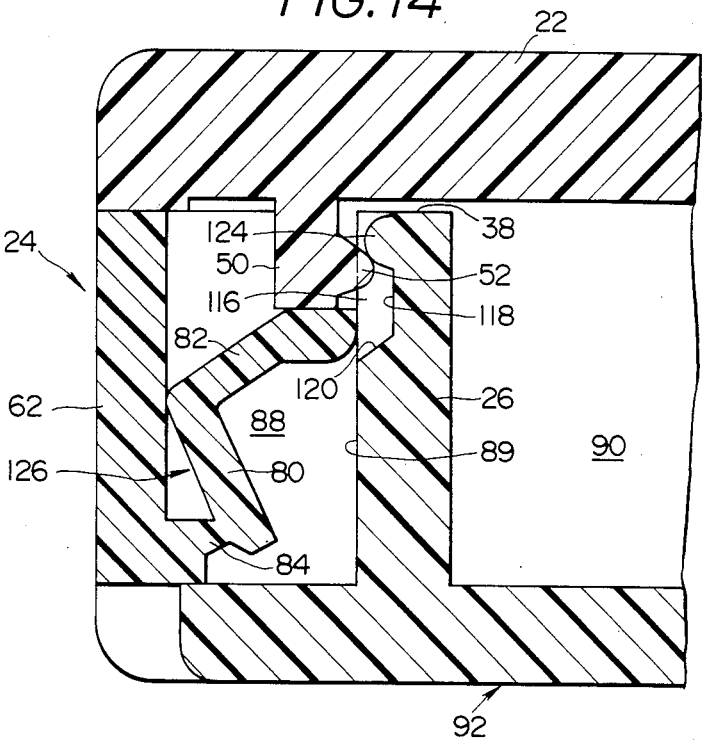
FIG. 14 is a fragmentary cross-sectional view of further modified form of the cosmetic case in FIG. 7.
Figure 15:
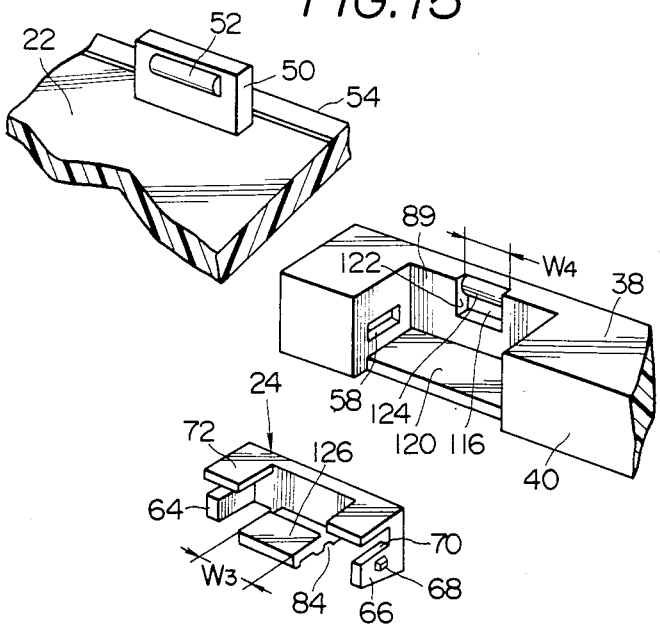
FIG. 15 is an exploded fragmentary perspective view of a case body, a lid and the a push button in FIG. 14.

A further modified form of the cosmetic case in FIG. 7 is illustrated in FIGS. 14 and 15, in which the urging leaf 126 does not have the notch 86. Instead of the notch 86, an auxiliary recess 116 is formed in the end surface 89 of the recess 88 so as to open to both the end surface 89 and the top face 38 of the front portion 26 of the peripheral wall 32. This auxiliary recess 116 is defined by end, bottom and opposite side surfaces 118, 120 and 122. On that portion of the end surface 118 adjacent to the top face 38 of the front portion 26, there is formed a engaging projection 124 which is adapted to be engaged with the engaging projection 52 of the lid 22. The width $W_3$ of the urging leaf 126 is larger than the width $W_4$ of the auxiliary recess 116, and thus, the auxiliary recess 116 can avoid any interference between the urging leaf 126 and the engaging projection 124.

Although, in the proceeding embodiment, both the case body and the lid are rectangular, a circular, ellipsoidal or polygonal case body and lid may be employed.

What is claimed is:

1. A compact cosmetic case comprising:

a case body having bottom and peripheral walls defining a hollow in the case body, the peripheral wall having front and rear portions, the front portion having top and front faces and provided with a recess opening to both the top and front faces of the front portion, the recess having bottom and end surfaces, the end surface extending between the bottom surface of the recess and the top face of the front portion, the end surface of the recess having a first engaging member projecting therefrom;

a lid having an inner face and pivotally connected to the rear portion of the peripheral wall of the case body for opening and closing the hollow of the case body, the lid having a second engaging member disposed on the inner face of the lid, for engaging with the first engaging member of the case body so that the lid is fastened to the front portion of the peripheral wall of the case body when the lid is in its closed position; and disengaging means received in the recess of the case body, for disengaging the first and second engaging members so that the lid is unfastened from the front portion of the peripheral wall of the case body, the disengaging means including: a sliding plate having inner surface, inner surface facing the end surface of the recess, said sliding plate having a lower edge and a ridge formed along said lower edge, the sliding plate being movable between outer and inner positions toward and away from the end surface of the recess; a hook-like resilient urging leaf interposed between the inner surface of the sliding plate and the end surface of the recess, for pushing the second engaging member upward so as to disengage the first and second engaging members, the urging leaf urging the sliding plate in its outer position away from the end surface of the recess; and a resilient strip disposed along the ridge of the sliding plate and interconnecting the ridge and the urging leaf, the urging leaf comprising:

a first leaf piece having upper and lower edges, the lower edge being connected to the ridge of the sliding plate by the resilient strip, the upper edge being spaced apart from the inner surface of the sliding plate by a clearance when the sliding plate is in its outer position, the first leaf piece having a larger thickness than the resilient strip; and a second leaf piece having proximal and distal edges, the distal edge being in contact with the end surface of the recess, the proximal edge being connected to the upper edge of the first leaf piece so that the second leaf piece is inclined at an angle less than 180° with respect to the first leaf piece, the second leaf piece having a thickness substantially equal to the thickness of the first leaf piece, the distal edge of the second leaf piece being disposed at a level below the first engaging member when the sliding plate is in its outer position, the urging leaf being bent, when the sliding plate is brought into its inner position, in such a manner that the angle between the first and second leaf pieces is enlarged and then the distal edge of the second leaf piece is brought to a level generally equal to the first engaging member, the second leaf piece having a notch formed in the distal edge thereof for preventing the distal edge from butting against the first engaging member when the distal edge is brought to the level generally equal to the first engaging member.

2. A compact cosmetic case as recited in claim 1, wherein the end surface of the recess has a stopper projecting therefrom, the stopper being disposed below the distal edge of the second leaf piece, for preventing the distal edge of the second leaf piece from moving downward beyond the stopper.

3. A compact cosmetic case as recited in claim 2, wherein the first engaging member extends in a direction parallel to both the bottom and end surfaces of the recess, and wherein the notch has a larger width than the length of the first engaging member.

4. A compact cosmetic case as recited in claim 3, wherein the disengaging means is of a unitary construction made of resilient material.

5. A compact cosmetic case as recited in claim 4, wherein the urging leaf has an inner face, the inner face having a partition groove formed between the first and second leaf pieces, the groove extending along the entire upper edge of the first leaf piece whereby a hinge portion of a relatively small thickness is formed between the first and second leaf pieces.

6. A compact cosmetic case as recited in claim 1, 4 or 3, wherein the urging leaf further comprises a channel-like curved element having first and second edges, the first edge of the curved element being joined to the upper edge of the first leaf piece, the second edge of the curved element being joined to the proximal edge of the second leaf piece, whereby the second leaf piece is interconnected to the first leaf piece.

7. A compact cosmetic case as recited in claim 6, wherein the disengaging means is of a unitary construction made of resilient material.

8. A compact cosmetic case as recited in claim 7, wherein the curved element has an inner face having a partition groove, the groove extending along the entire length of the channel-like curved element, whereby, in the curved element, a hinge portion of a relatively small thickness is formed.

* * * * *